United States Patent [19]

Weinreich

[11] 3,968,400

[45] July 6, 1976

[54] FLASH TUBE MODULATOR

[75] Inventor: Wayne C. Weinreich, Corona, Calif.

[73] Assignee: The United States of America as represented by the Secretary of the Navy, Washington, D.C.

[22] Filed: Mar. 30, 1965

[21] Appl. No.: 444,092

[52] U.S. Cl. ..... 315/209 R; 307/305; 315/176; 315/240; 315/244; 328/67

[51] Int. Cl.[2] ..... H05B 37/02

[58] Field of Search ..... 328/67, 68; 315/242, 315/243, 200 A, 209 R, 209 CD, 205, 223, 241 P, 172, 240, 241, 261, 262, 263, 174, 176; 307/252 R, 305

[56] References Cited

UNITED STATES PATENTS 2,993,144 7/1961 Grabner et al. ..... 315/205

3,163,782 12/1964 Ross ..... 307/88.5 X

*Primary Examiner*—R. V. Rolinec
*Assistant Examiner*—Lawrence J. Dahl
*Attorney, Agent, or Firm*—Richard S. Sciascia; J. M. St.Amand; T. M. Phillips

[57] ABSTRACT

A flash tube modulator circuit having a high peak power output at a high repetition rate (50 KC) with variable pulse widths by employing resonant charging and discharging to ionize the gas in a flash tube followed by a high current pulse to produce a high peak power output.

6 Claims, 1 Drawing Figure

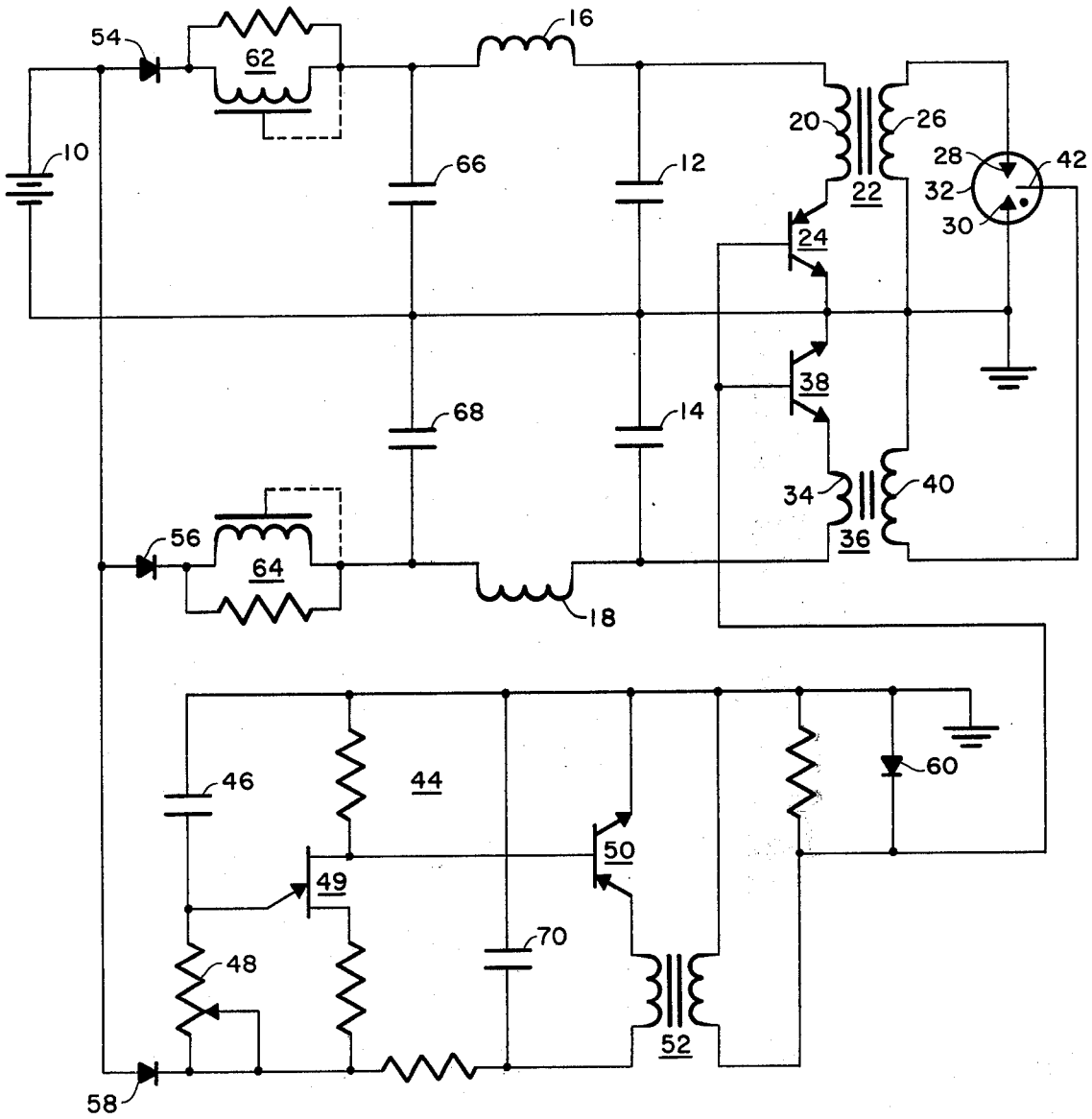
WAYNE C. WEINREICH
INVENTOR.
BY R. M. Phillips
J. M. St. Amand
ATTORNEYS

FLASH TUBE MODULATOR

The invention herein described may be manufactured and used by or for the Government of the United States of America for governmental purposes without the payment of any royalties thereon or therefor.

The present invention relates to flash tube modulators and particularly to means for pulse modulation of high pressure, short arc flash tubes at high peak power and high repetition rates. Prior flash tube modulators suffer from the disadvantages of either giving high peak power at low repetition rates or low peak power at low repetition rates and a fixed pulse width. In present day microwave and pulse type laser applications, high peak power with high repetition (50 kc) with variable pulse widths are desired.

An object of the invention is to provide a flash tube modulator which has a high repetition rate and high peak power output.

Another object is to provide a flash tube modulator which has a high repetition rate with high peak power output and variable pulse width.

Other objects and many of the attendant advantages of this invention will become readily appreciated as the same becomes better understood by reference to the following detailed description when considered in connection with the accompanying drawing wherein there is shown in the single FIGURE a flash tube modulator embodying the invention.

Referring now to the drawing there is shown a direct current voltage source 10 for supplying charging current to charging capacitors 12 and 14 through resonant induction coils 16 and 18 respectively. Connected across capacitor 12 is the primary winding 20 of a current transformer 22 in series with a silicon controlled rectifier 24. The secondary winding 26 of the current transformer 22 is connected across the anode 28 and cathode 30 of flash tube 32.

Connected across capacitor 14 is the primary winding 34 of a voltage transformer 36 in series with a silicon controlled rectifier 38. The secondary winding 40 of transformer 36 is connected across the control electrode 42 and cathode 30 of flash tube 32 which is also connected to ground.

Silicon controlled rectifiers 24 and 38 are each controlled simultaneously by output pulses from a free running relaxation oscillator 44 which is tuned to operate at two times the frequency of the resonant frequency of the coil 16 capacitor 12 and coil 18 capacitor 14 combination. The operating frequency of oscillator 44 is controlled by means of the capacity of capacitor 46 and the value of resistor 48. When capacitor 46 charges to the break-down voltage of unijunction transistor 48, a current will flow discharging capacitor 46 and the cycle will repeat. With the discharge of capacitor 46, silicon controlled rectifier 50 is turned on and a pulse appears across the secondary winding of transformer 52.

Rectifier 54, 56, 58, and 60 are provided to prevent reversal of current flow while current relays 62 and 64 are provided to insure turnoff of silicon controlled rectifiers 24 and 38 if the current flow becomes too great. Capacitors 66, 68, and 70 are provided to reduce transients.

In operation, when the voltage at source 10 is first applied to the parallel circuits, capacitor 12 will begin to resonant charge at the frequency given by $f = \frac{1}{2\pi}\sqrt{L_1C_1}$ where $L_1$ is the inductance of coil 16 and $C_1$ is the capacitance of capacitor 12 while capacitor 14 will begin to resonant charge at the frequency given by $f = \frac{1}{2\pi}\sqrt{L_2C_2}$ where $L_2$ is the inductance of coil 18 and $C_2$ is the capacitance of capacitor 14. Silicon controlled rectifiers 24 and 38 present a high impedance to the resonant charging circuits while in the non-conducting condition. Since oscillator 44 is operating at two times the resonant charging frequency of the resonant charging circuits, silicon controlled rectifiers will be turned on after capacitors 12 and 14 are charged to a voltage greater than that of source 10. When silicon controlled rectifiers are pulsed on, they present a low impedance with respect to the charging circuits permitting capacitor 12 to resonant discharge through primary winding 20 at a frequency given by $f = \frac{1}{2\pi}\sqrt{L_3C_3}$ where $L_3$ is the inductance of primary winding 20 and capacitor 14 to resonant discharge through primary winding 34 at a frequency given by $f = \frac{1}{2\pi}\sqrt{L_4C_2}$ where $L_4$ is the inductance of primary winding 34. Rectifiers 24 and 38 in the low impedance state act as diodes allowing current to flow in one direction. Transformer 36 should have sufficient turn ratio to step up the voltage in primary winding 34 to a value that will ionize the gas of tube 32. The ionizing of the gas in tube 32 by electrode 42 lowers its impedance allowing the high current pulse from transformer 22 to flow from anode 28 to cathode 30. Capacitors 12 and 14 are now charged with reversed polarity causing rectifiers 24 and 38 to return to a high impedance state and the resonant charging cycle begins again. With successive resonant charging and resonant discharging, amplification up to 15 times the input voltage from source 10 has been observed. An example of how this amplification is realized is as follows: The equations for the charging voltage and current for capacitor 12 are:

$$e_{c_1}(t) = \frac{E_{bb} - q_o/C_1}{C_1L_1}\left[\frac{1-\cos w_1t}{w_1^2}\right] + \frac{iO}{C_1W_1}\sin w_1t + \frac{q_o}{C_1} \quad (1)$$

$$i_1(t) = \frac{E_{bb} - q_o/C_1}{L_1w_1}(\sin w_1t) + i_o\cos w_1t \quad (2)$$

where $E_{bb}$ is the voltage of source 10, $q_o/c_1$ is the initial charge on capacitor 12. $w_1$ is equal to the resonant charging frequency $1/\sqrt{L_1C_1}$, and $i_o$ is the initial current through $L_1$. Assume no loss in the circuit, and that $i_o$ and $q_o/c_1$ are equal to zero at the time rectifier 24 is non-conducting and no voltage is applied from source 10, the equation for $e_c(t)$ and $i_1(t)$ is:

$$e_c(t) = E_{bb}(1-\cos w_1t) \quad (3)$$

$$i_1(t) = E_{bb}/L_1w_1(\sin w_1t) \quad (4)$$

If rectifier 24 is turned on at the time $w_1t$ is equal to 180°, and the resonant discharging frequency is much greater than the resonant charging frequency, then the expression for $e_c(t)$ and $i_2(t)$ is:

$$e_c(t) = q_o/C_1(\cos w_2t) \quad (5)$$

$$i_2(t) = q_o\, C_1 L_3\, (\sin w_2 t) \tag{6}$$

where, $w_2$ is equal to the resonant discharging frequency $1/\quad L_3C_1$, $i_2(t)$ is the current flow through primary winding 20 and $L_3$ is the inductance of primary winding 20.

The maximum value of $q_o/C_1$ is $2E_{bb}$, and from equation (5), $e_c(t)$ is equal to $-2E_{bb}$ at $w_2t$ equal to 180°.

If rectifier 24 is non-conducting at $w_2t$ equal to 180°, then $q_o/C$ is equal to $2E_{bb}$ and $i_o$ is equal to zero. $C_1$ will begin to resonant charge but equation (1) is:

$$e_c(t) = (E_{bb} + 2E_{bb})\,(1 - \cos w_1 t)$$

$$-2E_{bb} = 4E_{bb} \text{ for } w_1 t = 180° \tag{7}$$

If rectifier 24 is again caused to conduct at the time $w_1t$ is equal to 180°, and turned off at the time $w_2t$ is equal to 180° $q_o/C_1$ will be equal to $-4E_{bb}$. Then for the next charge cycle $e_c(t)$ will be equal to $6E_{bb}$ at $w_1t$ equal to 180° etc.

Obviously many modifications and variations of the present invention are possible in the light of the above teachings. It is therefore to be understood that within the scope of the appended claims the invention may be practiced otherwise than as specifically described.

What is claimed is:

1. A flashtube modulator circuit comprising:

a. a flashtube having an anode, cathode and trigger electrode, b. a current transformer having a secondary winding coupled across said anode and cathode of said flash tube and having a primary winding, c. a first resonant discharging circuit including an on-off switch connected in series with said high current transformer primary winding across a first capacitor, d. a first resonant charging circuit including a charging inductor connected in series with said first capacitor, e. a source of direct current coupled across said resonant charging circuit, f. a high voltage transformer having a secondary winding connected between the trigger electrode and cathode of said flashtube, g. a second resonant discharging circuit including the primary winding of said high voltage transformer connected in series with an on-off switch across a second capacitor, h. a second resonant charging circuit including a charging inductor connected in series with said second capacitor across said direct current power supply, i. circuit control means coupled to said on-off switches for simultaneously discharging said capacitors through said transformer primary windings when said capacitors are charged to a maximum voltage, j. whereby through successive resonant charging and discharging of said first and second capacitors the peak voltage developed across each of said primary windings is at least twelve times the amplitude of said input voltage.

2. The modulator circuit of claim 1 wherein said circuit control means is a free running relaxation oscillator operating at a frequency twice the resonant charging frequency.

3. The modulator circuit of claim 1 wherein said on-off switches are silicon controlled rectifiers.

4. The modulator circuit of claim 2 wherein said first resonant charging and discharging circuit comprises:

a. a capacitor connected in series with an inductive winding across said source of direct current, b. the primary winding of a current transformer connected in series with a silicon controlled rectifier across said capacitor.

5. The modulator circuit of claim 2 wherein said second resonant charging and discharging circuit comprises:

a. a capacitor connected in series with an inductive winding across said source of direct current, b. the primary winding of a step-up voltage transformer connected in series with a silicon controlled rectifier across said capacitor.

6. The modulator circuit of claim 3 wherein said circuit means for discharging said charging circuits is a free running relaxation oscillator operating at a frequency twice of the resonant charging frequency of said resonant charging circuit.

* * * * *